US008794784B1

(12) United States Patent
Maloney et al.

(10) Patent No.: US 8,794,784 B1
(45) Date of Patent: Aug. 5, 2014

(54) RECESSED CAN LAMPSHADE ACCESSORY

(71) Applicants: Darren V. Maloney, Panton Hill (AU); Meanie A. Maloney, Panton Hill (AU)

(72) Inventors: Darren V. Maloney, Panton Hill (AU); Meanie A. Maloney, Panton Hill (AU)

( * ) Notice: Subject to any disclaimer, the term of this patent is extended or adjusted under 35 U.S.C. 154(b) by 0 days.

(21) Appl. No.: 13/770,507

(22) Filed: Feb. 19, 2013

(51) Int. Cl.
*F21S 8/00* (2006.01)
*F21V 1/00* (2006.01)

(52) U.S. Cl.
CPC ..... *F21V 1/00* (2013.01)
USPC ..... 362/148; 362/147; 362/405; 362/432

(58) Field of Classification Search
USPC ..... 362/145, 147, 405, 432, 457, 458, 406, 362/148
See application file for complete search history.

(56) References Cited

U.S. PATENT DOCUMENTS

| | | | | |
|---|---|---|---|---|
| 897,947 | A * | 9/1908 | Wilson | 248/344 |
| 3,735,329 | A * | 5/1973 | Funabashi et al. | 439/323 |
| D243,875 | S | 3/1977 | Schwartz | |
| 4,337,506 | A | 6/1982 | Terada | |
| 4,528,620 | A * | 7/1985 | Weber | 362/86 |
| 4,748,549 | A * | 5/1988 | Scheer | 362/406 |
| 4,933,822 | A | 6/1990 | NakaMats | |
| 5,430,630 | A | 7/1995 | Kudishevich et al. | |
| 6,070,995 | A * | 6/2000 | Kanai | 362/365 |
| 6,203,174 | B1 | 3/2001 | Plumeyer | |
| 6,276,816 | B1 | 8/2001 | Dozsa-Farkas | |
| 6,371,632 | B1 * | 4/2002 | Lavy | 362/406 |
| 6,517,223 | B2 * | 2/2003 | Hsu | 362/405 |
| 6,632,005 | B1 * | 10/2003 | Johnson | 362/351 |
| 6,767,117 | B2 * | 7/2004 | De'Armond | 362/432 |
| 6,769,785 | B1 * | 8/2004 | Herst et al. | 362/147 |
| 6,927,677 | B2 * | 8/2005 | Anderson et al. | 340/435 |
| 6,935,765 | B2 * | 8/2005 | Hsu | 362/405 |
| 6,945,676 | B1 * | 9/2005 | Scott | 362/396 |
| 7,455,433 | B2 * | 11/2008 | Pazula et al. | 362/405 |
| 8,517,553 | B2 * | 8/2013 | Lan et al. | 362/96 |

* cited by examiner

*Primary Examiner* — John A Ward
(74) *Attorney, Agent, or Firm* — Kyle A. Fletcher, Esq.

(57) ABSTRACT

The recessed can lampshade accessory is able to be configured for use with an existing recessed can that is mounted on a ceiling. The recessed can lampshade accessory includes a plurality of arm supports that each includes an attachment clip on a distal end. The attachment clip enables the respective support arm to clip onto the recessed can fixture, and from which the arm support extends downwardly in order for a lamp shade to attach thereon. The lamp shade is suspended below the recessed can in order to diffuse light directed therefrom, and which also resembles a lamp shade.

11 Claims, 3 Drawing Sheets

RECESSED CAN LAMPSHADE ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of lampshades, more specifically, a lampshade that is uniquely adapted for use with a recessed can located on a ceiling.

B. Discussion of the Prior Art

As will be discussed immediately below, no prior art discloses a lamp shade assembly that is adapted to secure itself to a recessed can located on a ceiling; wherein the lamp shade assembly includes a plurality of arm supports that each include an attachment clip on a distal end; wherein the attachment clip enables the respective support arm to clip onto the recessed can fixture, and from which the arm support extends downwardly in order for a lamp shade to attach thereon; wherein the lamp shade is suspended below the recessed can in order to diffuse light directed therefrom, and which also resembles a lamp shade.

The Swarens et al. Patent (U.S. Pat. No. 5,430,630) discloses a light beam converter and deflector for recessed lighting fixtures, particularly those mounted in ceilings. However, the light beam converter is not an accessory for use with ceiling-mounted recessed can or light fixtures, and which suspends a lamp shade thereunder in order to diffuse light.

The NakaMats Patent (U.S. Pat. No. 4,933,822) discloses a light transmitting device that uses a mirror to reflect the light to the desired position. Again, the device does not support a lampshade underneath a recessed can or ceiling-mounted light fixture in order to diffuse light therefrom.

The Plumeyer Patent (U.S. Pat. No. 6,203,174) discloses an accessory reflector unit for reflector lamps and illumination systems that permits a change of direction of light emitted from a reflector lamp. Again, the accessory is unable to suspend a lampshade underneath a recessed can or ceiling-mounted light fixture.

The Terada Patent (U.S. Pat. No. 4,337,506) discloses an adjustable floor or table lamp with a diffuser globe surrounding a light source for providing general diffusion of light in a room, and an adjustable reflector above the diffuser for reflecting a portion of the light. Again, the globe is not able to suspend a lamp shade underneath a ceiling-mounted light fixture or recessed can.

The Dozsa-Farkas et al. Patent (U.S. Pat. No. 6,276,816) discloses a radiation-deflecting system that can be used in particular as a lighting system for rooms, halls, stores or the like. Again, the globe is not able to suspend a lamp shade underneath a ceiling-mounted light fixture or recessed can.

The Schwartz Patent (U.S. Pat. No. Des. 243,875) illustrates an ornamental design for a light bulb reflector.

While the above-described devices fulfill their respective and particular objects and requirements, they do not describe a lamp shade assembly that is adapted to secure itself to a recessed can located on a ceiling; wherein the lamp shade assembly includes a plurality of arm supports that each include an attachment clip on a distal end; wherein the attachment clip enables the respective support arm to clip onto the recessed can fixture, and from which the arm support extends downwardly in order for a lamp shade to attach thereon; wherein the lamp shade is suspended below the recessed can in order to diffuse light directed therefrom, and which also resembles a lamp shade. In this regard, the recessed can lampshade accessory departs from the conventional concepts and designs of the prior art.

SUMMARY OF THE INVENTION

The recessed can lampshade accessory is able to be configured for use with an existing recessed can that is mounted on a ceiling. The recessed can lampshade accessory includes a plurality of arm supports that each includes an attachment clip on a distal end. The attachment clip enables the respective support arm to clip onto the recessed can fixture, and from which the arm support extends downwardly in order for a lamp shade to attach thereon. The lamp shade is suspended below the recessed can in order to diffuse light directed therefrom, and which also resembles a lamp shade.

An object of the invention is to provide an accessory that is configured to work with a recessed can, and which suspends a lampshade down there from in order to diffuse light and provide additional decorative effect.

A further object of the invention is to provide a recessed can lampshade accessory that includes arm supports that attach to the recessed can and extending downwardly onto which a lampshade is suspended.

A further object of the invention is to provide a plurality of arm supports that attach around the recessed can in order to support the lampshade at varying locations around the lampshade.

These together with additional objects, features and advantages of the recessed can lampshade accessory will be readily apparent to those of ordinary skill in the art upon reading the following detailed description of presently preferred, but nonetheless illustrative, embodiments of the recessed can lampshade accessory when taken in conjunction with the accompanying drawings.

In this respect, before explaining the current embodiments of the recessed can lampshade accessory in detail, it is to be understood that the recessed can lampshade accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the recessed can lampshade accessory.

It is therefore important that the claims be regarded as including such equivalent construction insofar as they do not depart from the spirit and scope of the recessed can lampshade accessory. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
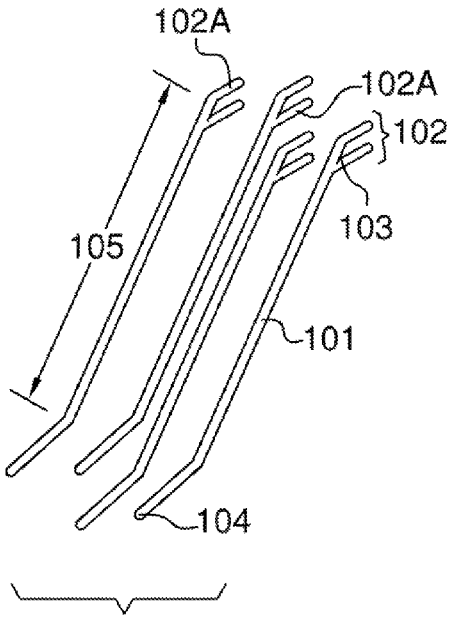
FIG. 1 illustrates a perspective view of the arm supports by themselves.
Figure 2:
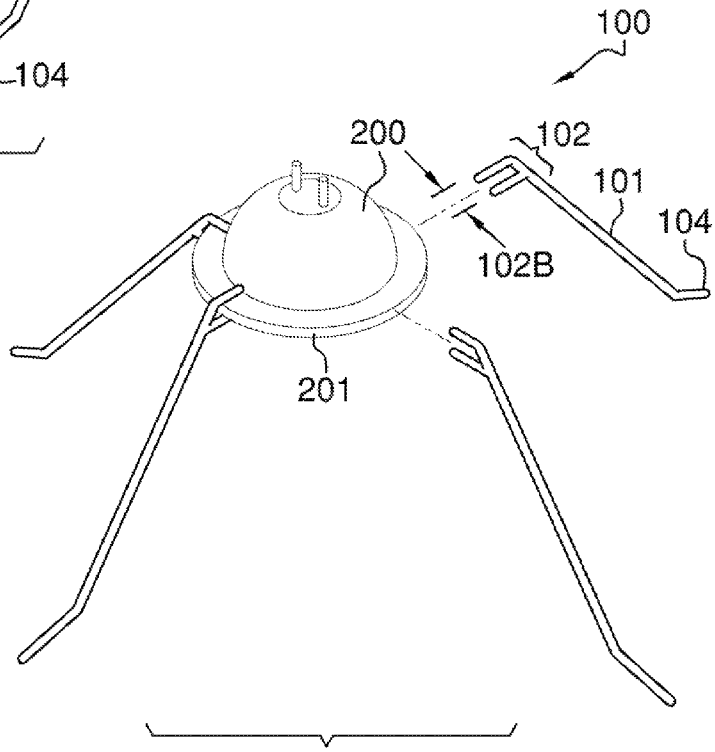
FIG. 2 illustrates a perspective view of the arm supports attaching onto the peripheral edge of the light fixture of the recessed can.
Figure 3:
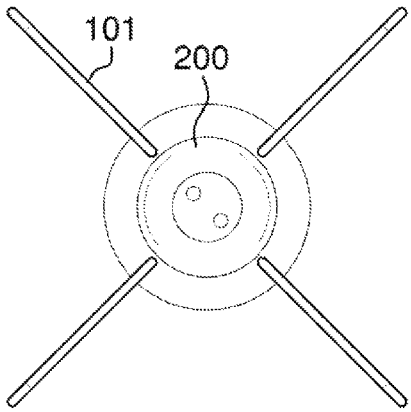
FIG. 3 illustrates a top view of the arm supports clipped onto the peripheral edge of the light fixture and forming a circular array around the light fixture.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A recessed can lampshade accessory 100 (hereinafter invention) includes a plurality of arm supports 101 that are each defined as a rod-like construction on which a clip member 102 is provided at a first end 103. The arm supports 101 are further defined with a lamp shade engaging end 104 that is opposite of the clip member 102. The arm supports 101 are also further defined with a support length 105. The arm supports 101 are made of a material comprising a plastic or metal or other material suitable for managing the stresses of use.

The clip members 102 are each configured to clip onto a peripheral edge 201 of a light fixture 200. The clip member 102 is comprised of two parallel clip arms 102A that are distanced one from another in order for the clip member 102 to clip onto the peripheral edge 201 of the light fixture 200. It shall be noted that the term light fixture 200 is being used interchangeably with a recessed can or other fixture that is mounted on a ceiling surface 300. The light fixture 200 directs light downwardly from the ceiling surface 300.

The lamp shade engaging end 104 of each arm support 101 is provided in order to support a lamp shade 120 in a parallel orientation with respect to the ceiling surface 300. Moreover, the lamp shade engaging end 104 engages a top, inner edge 121 of the lamp shade 120 in order to support the lamp shade 120 from above the lamp shade 120. The arm supports 101 are connected to the peripheral edge 201 of the light fixture 200 via the clip members 102. The arm supports 101 extend downwardly as well as radially from the peripheral edge 201. The arm supports 101 form a circular array around the light fixture 200 in order to support the lamp shade 120 at various points around the top, inner edge 121 of the lamp shade 120 (see FIG. 3).

Figure 4:
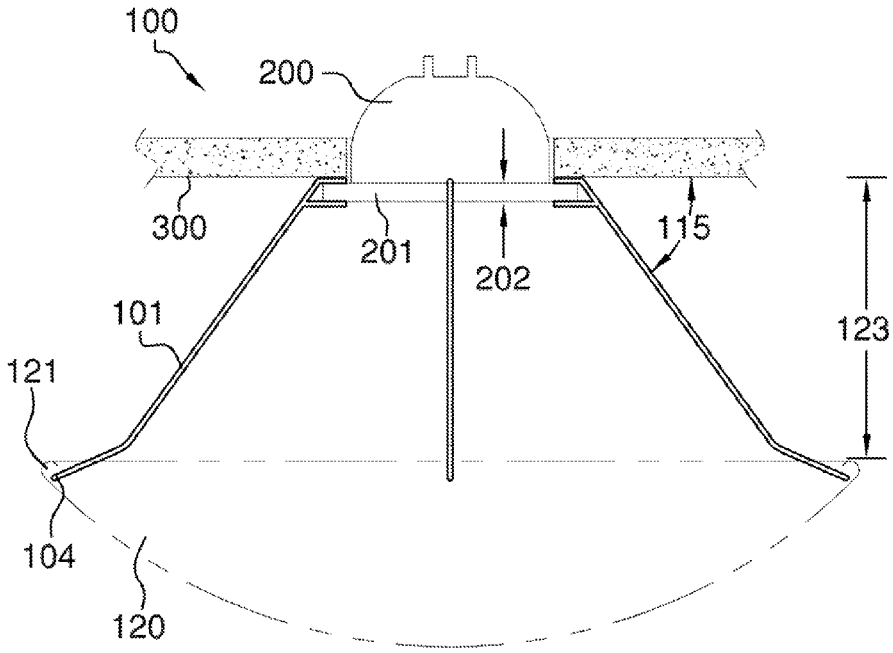
FIG. 4 illustrates a side view of the recessed can lampshade accessory installed and in use with the light fixture of the recessed can.

Referring to FIG. 4, the clip members 102 utilize the two parallel clip arms 102A to engage above as well as below the peripheral edge 201 of the light fixture 200. The arm supports 101 extend downwardly at an angle 115 with respect to the peripheral edge 201 of the light fixture 200. The two parallel clip arms 102A are separated from one another via a clip arm length 102B, which is greater than or equal to a peripheral edge height 202 of the light fixture 200.

The arm supports 101 support the lamp shade 120 at a parallel orientation with respect to the ceiling surface 300, and also a lamp shade distance 122 formed between the ceiling surface 300 and the top, inner edge 121 of the lamp shade 120. It shall be noted that the greater the support length 105, the greater the lamp shade distance 122. The actual dimensions of the support length 105 and the lamp shade distance 122 are relative, and will be contingent upon the size of the light fixture 200 of use.

Figure 5:
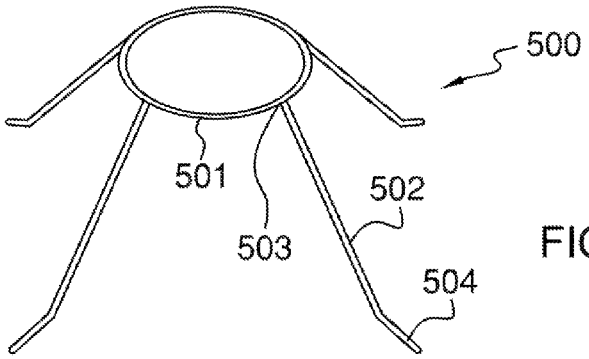
FIG. 5 illustrates an alternative embodiment of the recessed can lampshade accessory wherein a ring rigidly affixed to the arm supports.
Figure 6:
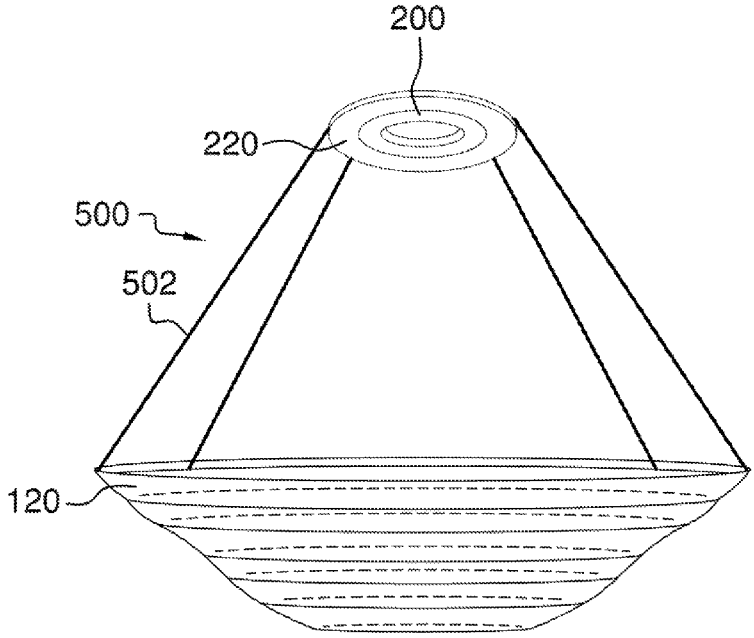
FIG. 6 illustrates a view of the alternative embodiment in use with a light fixture.

Referring to FIGS. 5-6, an alternative embodiment 500 utilizes a ring member 501 to support a plurality of support arms 502. The ring member 501 is rigidly affixed to a first end 503 of each support arm 502. Each support arm 502 includes a lamp shade engaging end 504 that is at an opposing end of the support arm 502 with respect to the ring member 501.

The alternative embodiment 500 is essentially replacing the clip member 102 in order to rigidly affix the support arm directly to the ring member 501. The ring member 501 is affixed above the ceiling plate 220 of the light fixture 200.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to these illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A recessed can lampshade accessory comprising:

a plurality of arm supports configured to attach to a peripheral edge of a ceiling-mounted light fixture or recessed can;

wherein the arm supports extend downwardly in order to support a lamp shade underneath said light fixture or recessed can in order to diffuse light therefrom;

wherein the plurality of arm supports are each defined as a rod-like construction on which a clip member is provided at a first end; wherein the clip member is responsible for securing the arm support onto the peripheral edge of the light fixture;

wherein the arm supports are further defined with a lamp shade engaging end that is opposite of the clip member; wherein the arm supports are also further defined with a support length;

wherein the clip members are each configured to clip onto the peripheral edge of the light fixture; wherein the clip member is comprised of two parallel clip arms that are distanced one from another in order for the clip member to clip onto the peripheral edge of the light fixture.

2. The recessed can lampshade accessory as described in claim 1 wherein the lamp shade engaging end of each arm support is provided in order to support the lamp shade in a parallel orientation with respect to a ceiling surface; wherein the lamp shade engaging end engages a top, inner edge of the lamp shade in order to support the lamp shade from above the lamp shade.

3. The recessed can lampshade accessory as described in claim 2 wherein the arm supports are connected to the peripheral edge of the light fixture via the clip members; wherein the arm supports extend downwardly as well as radially from the peripheral edge; wherein the arm supports form a circular array around the light fixture in order to support the lamp shade at various points around the top, inner edge of the lamp shade.

4. The recessed can lampshade accessory as described in claim 3 wherein the clip members utilize the two parallel clip arms to engage above as well as below the peripheral edge of the light fixture; wherein the arm supports extend downwardly at an angle with respect to the peripheral edge of the light fixture; wherein the two parallel clip arms are separated from one another via a clip arm length, which is greater than or equal to a peripheral edge height of the light fixture.

5. The recessed can lampshade accessory as described in claim 1 wherein the arm supports support the lamp shade at a parallel orientation with respect to the ceiling surface, and also a lamp shade distance formed between the ceiling surface and the top, inner edge of the lamp shade.

6. A recessed can lampshade accessory comprising:

a plurality of arm supports configured to attach to a peripheral edge of a ceiling-mounted light fixture or recessed can;

wherein the arm supports extend downwardly in order to support a lamp shade underneath said light fixture or recessed can in order to diffuse light therefrom;

wherein the plurality of arm supports are each defined as a rod-like construction on which a clip member is provided at a first end; wherein the clip member is responsible for securing the arm support onto the peripheral edge of the light fixture;

wherein the clip members are each configured to clip onto the peripheral edge of the light fixture; wherein the clip member is comprised of two parallel clip arms that are distanced one from another in order for the clip member to clip onto the peripheral edge of the light fixture.

7. The recessed can lampshade accessory as described in claim 6 wherein the arm supports are further defined with a lamp shade engaging end that is opposite of the clip member; wherein the arm supports are also further defined with a support length.

8. The recessed can lampshade accessory as described in claim 7 wherein the lamp shade engaging end of each arm support is provided in order to support the lamp shade in a parallel orientation with respect to a ceiling surface; wherein the lamp shade engaging end engages a top, inner edge of the lamp shade in order to support the lamp shade from above the lamp shade.

9. The recessed can lampshade accessory as described in claim 6 wherein the arm supports are connected to the peripheral edge of the light fixture via the clip members; wherein the arm supports extend downwardly as well as radially from the peripheral edge; wherein the arm supports form a circular array around the light fixture in order to support the lamp shade at various points around the top, inner edge of the lamp shade.

10. The recessed can lampshade accessory as described in claim 9 wherein the clip members utilize the two parallel clip arms to engage above as well as below the peripheral edge of the light fixture; wherein the arm supports extend downwardly at an angle with respect to the peripheral edge of the light fixture; wherein the two parallel clip arms are separated from one another via a clip arm length, which is greater than or equal to a peripheral edge height of the light fixture.

11. The recessed can lampshade accessory as described in claim 10 wherein the arm supports support the lamp shade at a parallel orientation with respect to the ceiling surface, and also a lamp shade distance formed between the ceiling surface and the top, inner edge of the lamp shade.

* * * * *